US005328176A

United States Patent [19]

Lo

[11] Patent Number: 5,328,176

[45] Date of Patent: Jul. 12, 1994

[54] COMPOSITE GOLF HEAD

[76] Inventor: Kun-Nan Lo, No. 33, Hsiang-Ho Rd., Li-Lin Tsun, Tan-Tzu Hsiang, Taichung Hsien, Taiwan

[21] Appl. No.: 74,937

[22] Filed: Jun. 10, 1993

[51] Int. Cl.[5] ..... A63B 53/04

[52] U.S. Cl. ..... 273/167 H; 273/DIG. 23

[58] Field of Search ..... 273/167 R, 77 A, 77 R, 273/DIG. 23

[56] References Cited

U.S. PATENT DOCUMENTS

| | | | |
|---|---|---|---|
| 838,284 | 12/1906 | Thompson | 273/78 |
| 1,349,806 | 8/1920 | Booth | 273/172 |
| 2,447,967 | 8/1948 | Stone | 273/169 X |
| 4,872,685 | 10/1989 | Sun | 273/169 |
| 4,883,275 | 11/1989 | Boone | 273/174 X |
| 5,135,227 | 8/1992 | Okumoto | 273/167 H X |
| 5,242,168 | 9/1993 | Aizawa | 273/167 H |

*Primary Examiner*—Jessica J. Harrison
*Assistant Examiner*—Sebastiano Passaniti
*Attorney, Agent, or Firm*—Curtis, Morris and Safford

[57] ABSTRACT

A composite golf head includes a head portion which is made of a carbon fiber composite material. The head portion has a front face, a rear face opposed to the front face, a top face, and a bottom face opposed to the top face. A metal reinforcing plate is fixed to the front face. The metal reinforcing plate has an upper extension fixed to a first part of the top portion. The metal reinforcing plate has a lower extension fixed to and wrapping around the bottom face and the rear face and extending to a second part of the top face.

2 Claims, 3 Drawing Sheets

COMPOSITE GOLF HEAD

BACKGROUND OF THE INVENTION

1. Field of the Invention

This invention relates to a composite golf head, more particularly to a composite golf head which is made of a carbon fiber composite material and a stainless steel material.

2. Description of the Related Art

Conventionally, golf heads are made of a single material. In the case where the golf head is made of the carbon fiber composite material, said golf head is lightweight and can vary in volume. However, golf heads constructed in this manner are liable to be broken and worn. In the case where the golf head is made of stainless steel, said golf head has good strength, high hardness and a firm feeling when striking. However, the volume of stainless steel golf heads cannot be too great because if the density of the stainless steel is too high, the weight of the golf heads is too heavy. Therefore, the volume of stainless steel golf heads and thereby its design capability are both limited.

SUMMARY OF THE INVENTION

It is therefore a main object of this invention to provide a composite golf head which is made of both a carbon fiber composite material and a stainless steel material so as to overcome the aforementioned disadvantages.

Accordingly, the composite golf head of this invention comprises a head portion which is made of a carbon fiber composite material. The head portion has a front face, a rear face opposed to the front face, a partially exposed top face, and a bottom face opposed to the top face. An exposed metal reinforcing plate is fixed to the front face. The metal reinforcing plate has an upper extension fixed to a first part of the top portion. The metal reinforcing plate has a lower extension fixed to and wrapping around the bottom face and the rear face and extending to a second part of the top face. The second part of the top face is spaced from and opposed to the first part of the top face.

In a preferred embodiment of this invention, the metal reinforcing plate is made of a stainless steel material.

Other features and advantages of this invention will become apparent in the following detailed description of the preferred embodiment of this invention with reference to the accompanying drawings.

DETAILED DESCRIPTION OP THE PREFERRED EMBODIMENT

Figure 1:
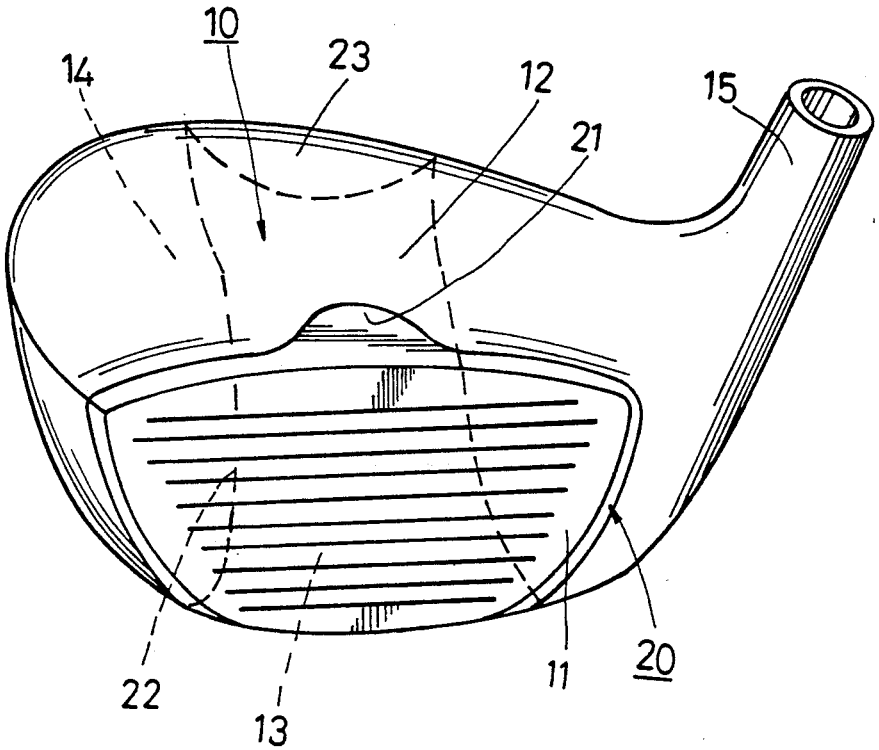
FIG. 1 is a perspective view of a preferred embodiment of a composite golf head of this invention.
Figure 2:
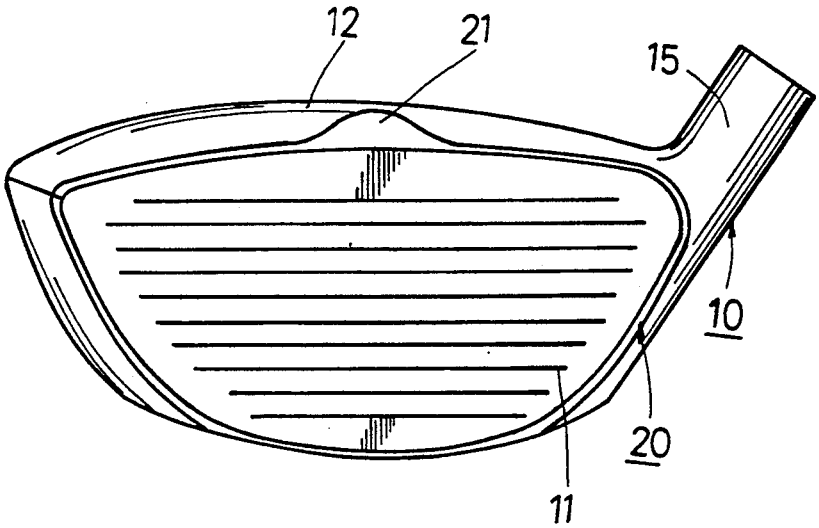
FIG. 2 is a front view of the preferred embodiment of the composite golf head of this invention.
Figure 3:
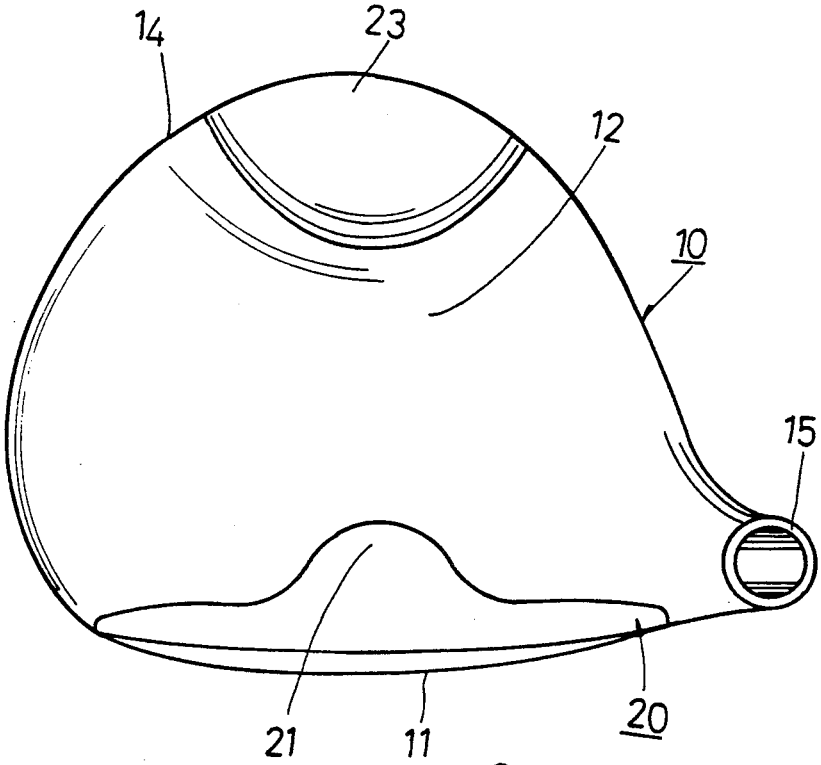
FIG. 3 is atop view of the preferred embodiment of the composite golf head of this invention.
Figure 4:
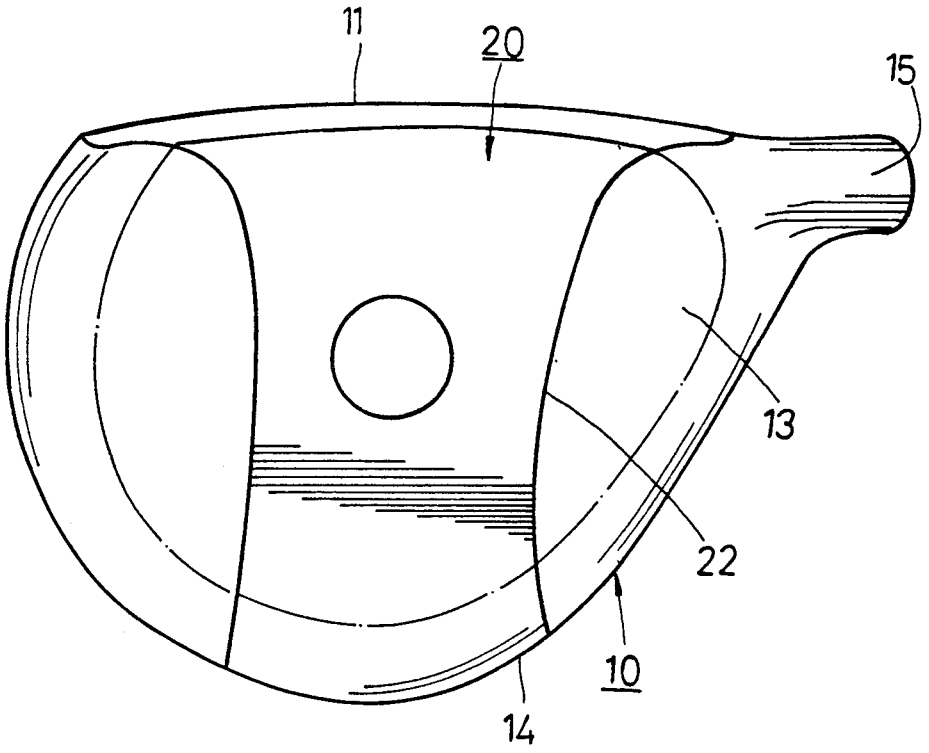
FIG. 4 is a bottom view of the preferred embodiment of the composite golf head of this invention.
Figure 5:
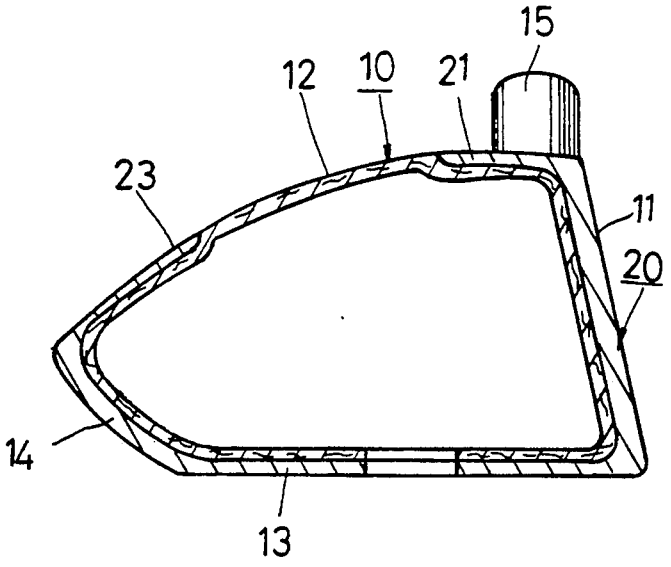
FIG. 5 is a sectional view of the preferred embodiment of the composite golf head of this invention.

FIG. 1 shows a perspective view of a preferred embodiment of a composite golf head of this invention. The composite golf head is comprised of a head portion (10) which is made of a carbon fiber composite material. A neck portion (15) is integrally formed with the head portion (10) in order to enable it to be connected to a shaft (not shown). An exposed metal reinforcing plate (20) is fixed to the front face of the head portion (10). The metal reinforcing plate (20) is made of a stainless steel material. The metal reinforcing plate (20) has a convex upper extension (21) fixed to the first part of the exposed top portion (12) of the head portion (10), as best illustrated in FIGS. 1 and 2. The metal reinforcing plate (20) has a strip-like lower extension (22) fixed to and wrapping around the bottom face (13) and the rear face (14) of the head portion (10), as best illustrated in FIGS. 4 and 5. The convex free end (23) of the lower extension (22) of the metal reinforcing plate (20) extends to a second part of the top face (12). The first and second parts of the top face (12) are spaced from and opposed to each other, as best illustrated in FIG. 3.

It is found that the composite golf head of this invention has the stainless steel reinforcing plate (20) in order to ensure the strength of the golf head and has the carbon fiber head portion (10) in order to reduce the weight of the head portion (10). Therefore, according to this invention, the golf head's center of gravity can be varied as required during manufacturing. In addition, the volume of the golf head can be designed so as to be greater than that of a conventional stainless steel golf head. Therefore, the composite golf head can be formed into different sizes as desired.

When manufacturing the composite golf head of this invention, the metal reinforcing plate (20) and the upper and lower extensions (21, 22) are made by a precise casting process. The inner surfaces of the metal reinforcing plate (20) and the upper and lower extensions (21, 22) that are to be connected to the carbon fiber composite head portion (10) are toughened by means of a sandblasting method. The carbon fiber impregnated with a composite material is then disposed in the space defined by the metal reinforcing plate (20) and the upper and lower extensions (21, 22). The carbon fiber composite material and the metal reinforcing plate are disposed in a mold and are heated and pressurized for a predetermined period of time in order to join the carbon fiber composite material and the metal reinforcing plate together. A composite golf head is thus obtained. Of course, a finishing process can follow in order to obtain a finished composite golf head.

With this invention thus explained, it is apparent that numerous modifications and variations can be made without departing from the scope and spirit of this invention. It is therefore intended that this invention be limited only as indicated in the appended claims.

I claim:

1. A composite golf head comprising:

a head portion which is made of a carbon fiber composite material, said head portion having a front face, a rear face opposed to said front face, a partially exposed top face, and a bottom face opposed to said top face; and an exposed metal reinforcing plate fixed to said front face, said metal reinforcing plate having an upper extension fixed to a first part of said top portion, and a lower extension fixed to and wrapping around said bottom face and said rear face and extending to a second part of said top face, the second part of said top face being spaced from and opposed to the first part of said top face.

2. A composite golf head as claimed in claim 1, wherein said metal reinforcing plate is made of a stainless steel material.

* * * * *